US006159043A

United States Patent [19]

Yao et al.

[11] Patent Number: 6,159,043

[45] Date of Patent: Dec. 12, 2000

[54] BOARDLOCK FOR AN ELECTRICAL CONNECTOR

[75] Inventors: Jason Yao, Tu-Chen; Shao-Ming Fu, Pan-Chiao, both of Taiwan

[73] Assignee: Hon Hai Precision Ind. Co., Ltd., Taipei Hsien, Taiwan

[21] Appl. No.: 09/405,509

[22] Filed: Sep. 23, 1999

[30] Foreign Application Priority Data

May 11, 1999 [TW] Taiwan ..... 88207477

[51] Int. Cl.[7] ..... H01R 13/73

[52] U.S. Cl. ..... 439/567

[58] Field of Search ..... 439/567, 571, 439/572

[56] References Cited

U.S. PATENT DOCUMENTS 5,085,589 2/1992 Kan ..... 439/92

5,797,769 8/1998 Yang et al. ..... 439/567

*Primary Examiner*—Gary F. Paumen

*Attorney, Agent, or Firm*—Wei Te Chung

[57] ABSTRACT

A boardlock for an electrical connector comprises a base adapted for being attached to a housing of the electrical connector, and a latch extending from the base. The latch forms first and second barbs extending from opposite edges proximate a free end thereof. The first and second barbs are respectively bent along different lines which are slightly slanted relative to a longitudinal direction of the latch and extend toward the free end of the latch whereby the first barb extends in a direction that is not parallel to the direction that the second barb extends in. An elongate aperture is formed between the first and second barbs.

2 Claims, 5 Drawing Sheets

BOARDLOCK FOR AN ELECTRICAL CONNECTOR

BACKGROUND OF THE INVENTION

1. Field of the Invention

The present invention relates to a boardlock having a latch for securing to a printed circuit board, and especially to a boardlock having bent barbs on the latch.

2. Description of Prior Art

Generally, an electrical connector is mounted on a printed circuit board (PCB) by soldering. Some electrical connectors have boardlocks for fastening the connectors to the PCB before the connector is soldered to the PCB. Conventional boardlocks are disclosed in Taiwan Patent Application Nos. 85207102, 85217850 and 86211261 and U.S. Pat. No. 5,085,589.

Referring to FIG. 1, a conventional electrical connector 100 comprises a housing member 102, a pair of boardlocks 104 attached to the housing member 102 and a pair of grommets 106 extending through the boardlocks 104 and the housing member 102. Each boardlock 104 includes a base 108 and first and second latches 110, 112 extending from an edge of the base 108. The first latch 110 lies in a plane substantially perpendicular to the base 108, while the second latch 112 lies in the same plane as the base 108. First and second barbs 114, 116 are respectively formed at free ends of the first and the second latches 110, 112 for engaging with a PCB (not shown) thereby fastening the connector 100 to the PCB. The first and second barbs 114, 116 lie in the plane substantially perpendicular to the base 108 and extend in opposite directions.

Since the barbs 114, 116 extend in opposite directions and substantially align with each other, contact surfaces between the boardlock 104 and the PCB substantially lie in the same plane. Thus, the boardlock 104 can be easily disengaged from the PCB. Furthermore, the structure of the boardlock 104 complicates the manufacturing process.

BRIEF SUMMARY OF THE INVENTION

Accordingly, an object of the present invention is to provide a boardlock for an electrical connector having bent barbs whereby the boardlock can be securely inserted into a printed circuit board.

Another object of the present invention is to provide a boardlock which can be easily manufactured.

The boardlock for an electrical connector in accordance with a preferred embodiment of the present invention comprises a base adapted for being attached to a housing of the electrical connector and a latch extending from the base. The latch comprises a planar portion and first and second barbs on two opposite side edges of the planar portion. The first and second barbs are respectively bent to lie in opposite sides of the planar portion.

Other objects, advantages and novel features of the invention will become more apparent from the following detailed description when taken in conjunction with the accompanying drawings.

DETAILED DESCRIPTION OF THE INVENTION

Figure 1:
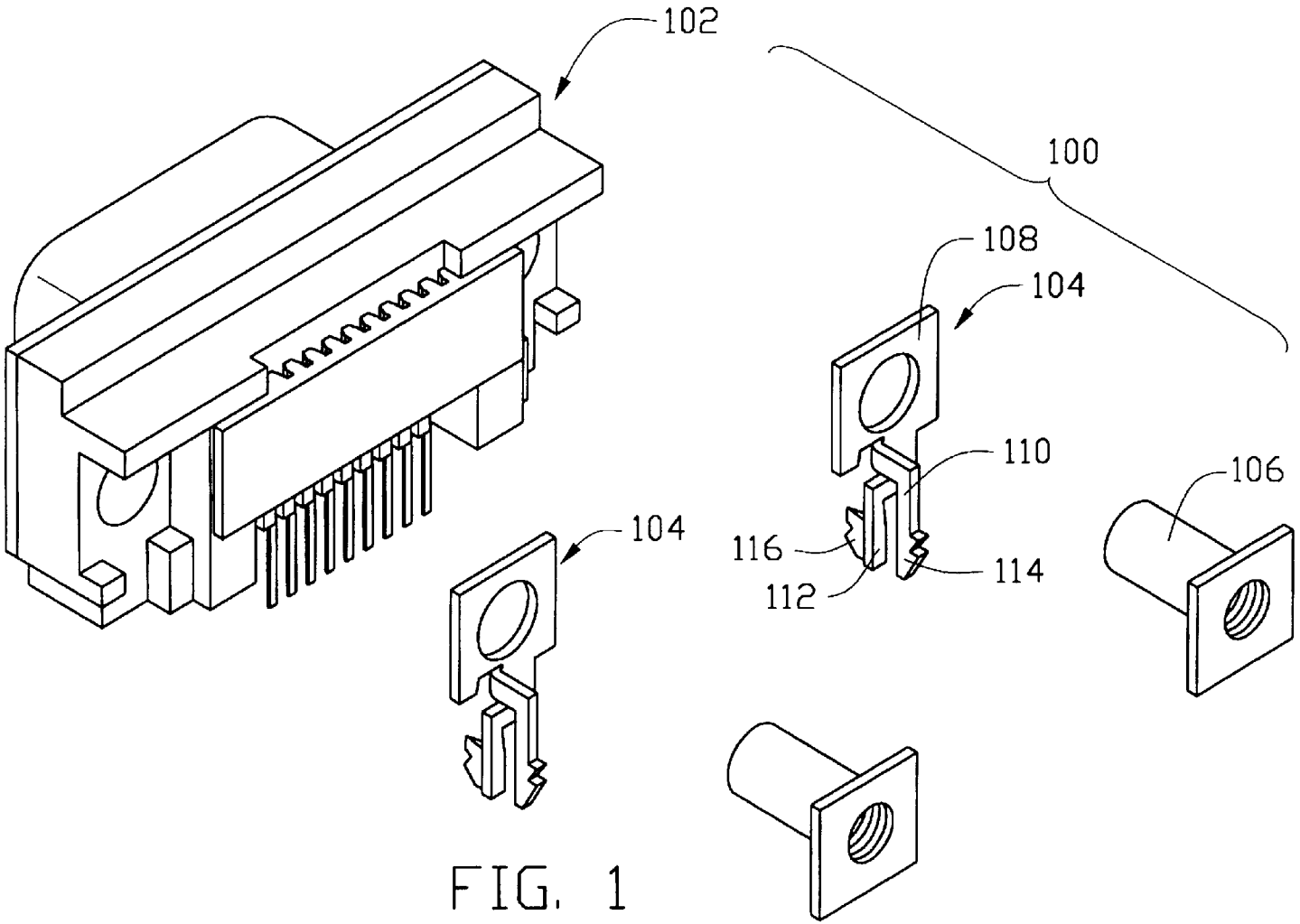
FIG. 1 (PRIOR ART)
FIG. 1 is an exploded view of a conventional electrical connector.
Figure 2:
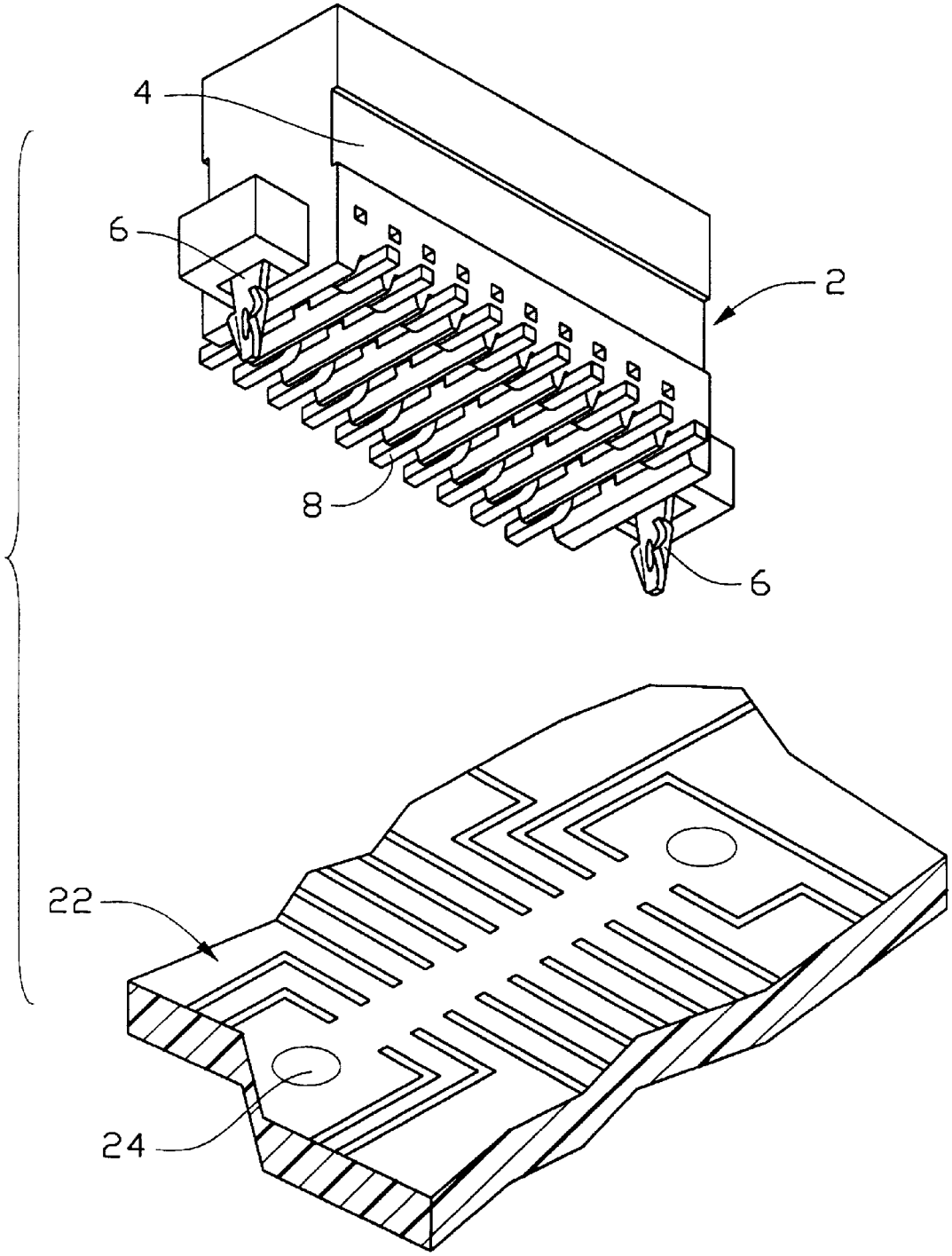
FIG. 2 is an assembled view of an electrical connector embodying the concepts of the present invention and a printed circuit board.
Figure 3:
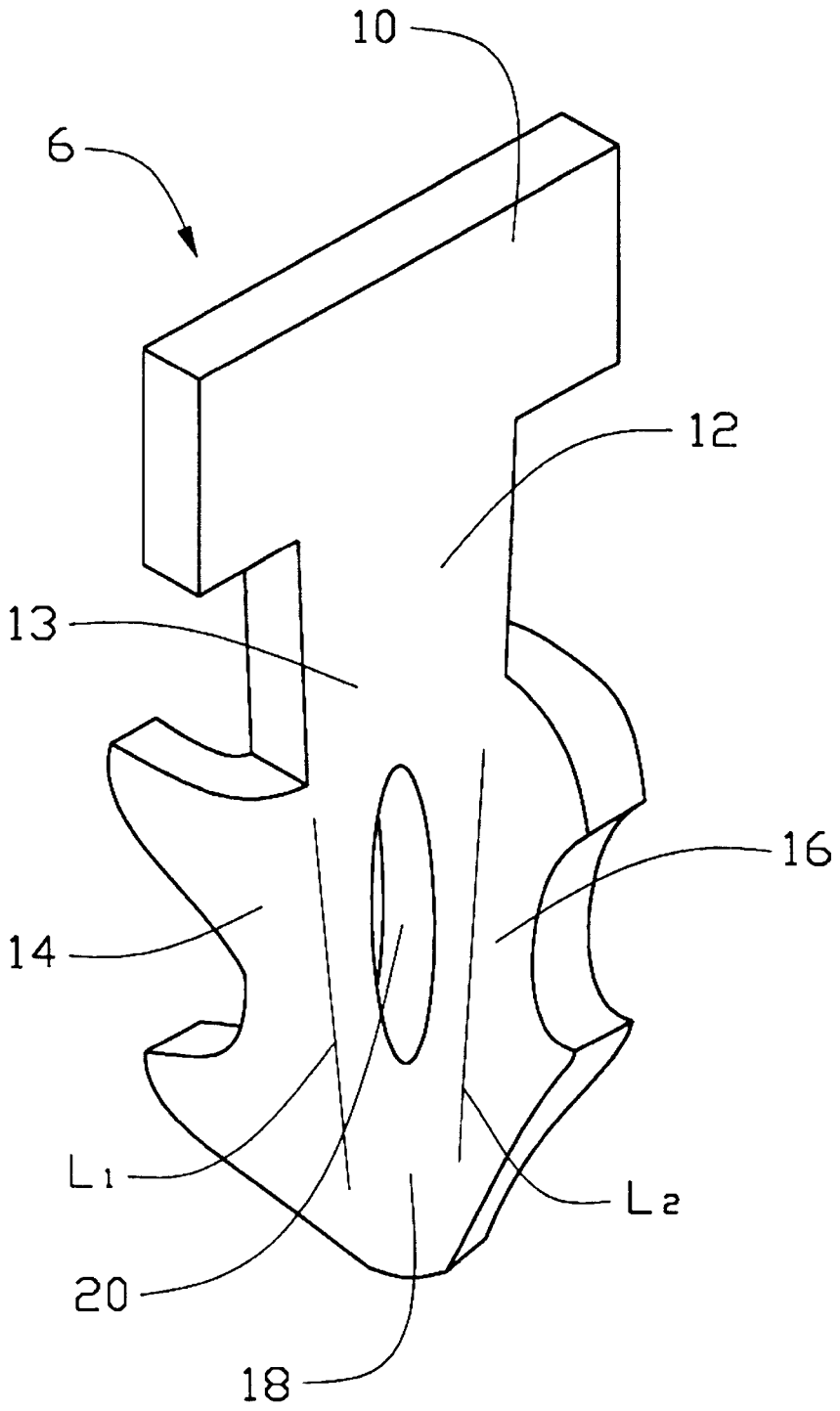
FIG. 3 is a perspective view of a boardlock of the present invention.
Figure 4:
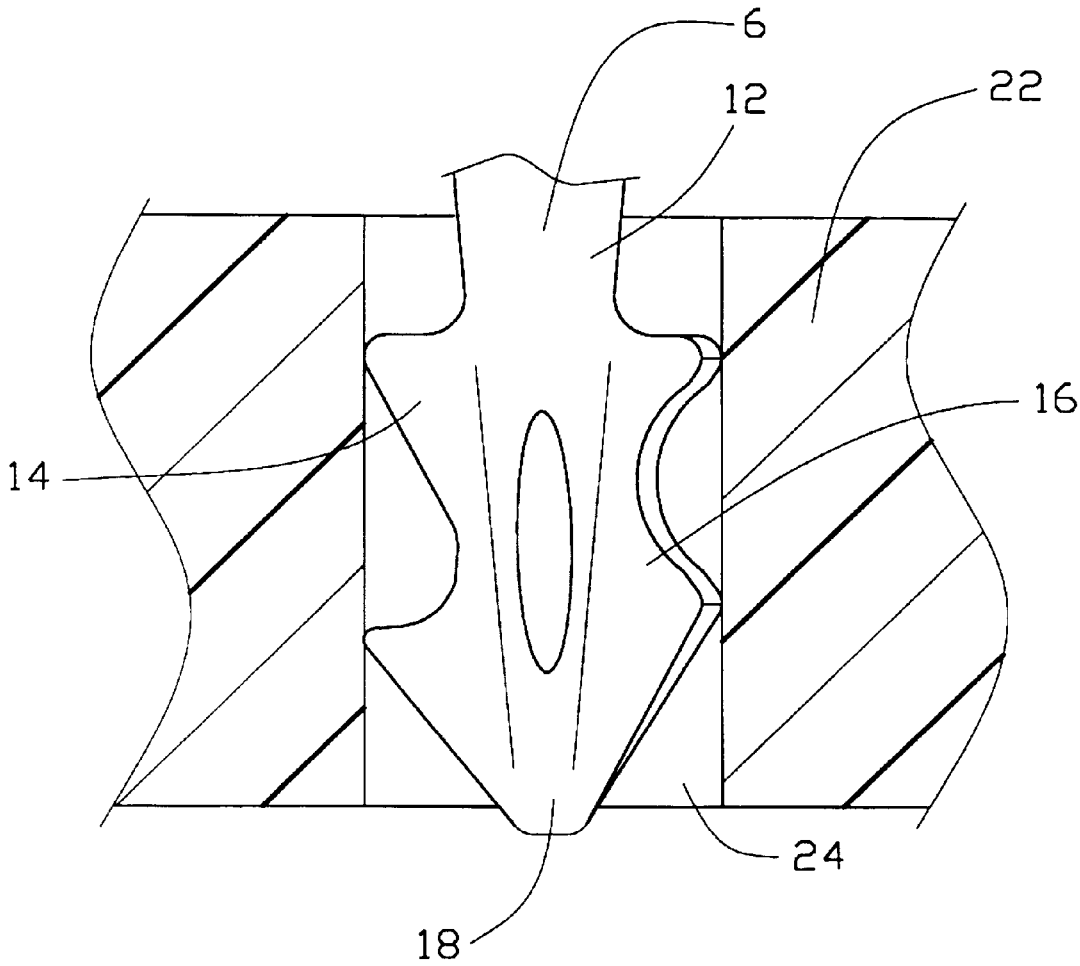
FIG. 4 is a partial, cross sectional view of the PCB with the boardlock received therein.

Referring to FIGS. 2–4, an electrical connector 2 in accordance with the present invention includes a housing 4, a pair of boardlocks 6 interferentially received in the housing 4 and a plurality of terminals 8 retained in the housing 4.

Each boardlock 6 includes a base 10 for being interferentially received in the housing 4 and a latch 12 extending from an edge of the base 10. The latch 12 forms a planar portion 13 and first and second barbs 14, 16 extending from opposite edges of the planar portion 13 proximate a free end 18 thereof. The first and second barbs 14, 16 each include two protrusions and are bent along lines L1, L2, respectively to make the four protrusions not lie in a plane. The lines L1, L2 are slightly slanted relative to a longitudinal direction of the latch 12 and toward the free end 18 of the latch 12. Thus, the first barb 14 extends in a direction that is not parallel to the direction that the second barb 16 extends in. An elongate aperture 20 is formed between the first and second barbs 14, 16 for enhancing the resiliency of the latch 12. Therefore, the structure of the boardlock 6 is simple and easy to manufacture.

In assembly, the electrical connector 2 is attached to a printed circuit board (PCB) 22 with each boardlock 6 being inserted into a corresponding hole 24 defined in the PCB 22. The contact surfaces between the barbs 14, 16 of the boardlocks 6 and the PCB 22 do not lie in the same plane since the first barb 14 and the second barb 16 do not align with each other. Thus, the boardlock 6 is securely fixed in the hole 24 of the PCB 22.

Figure 5:
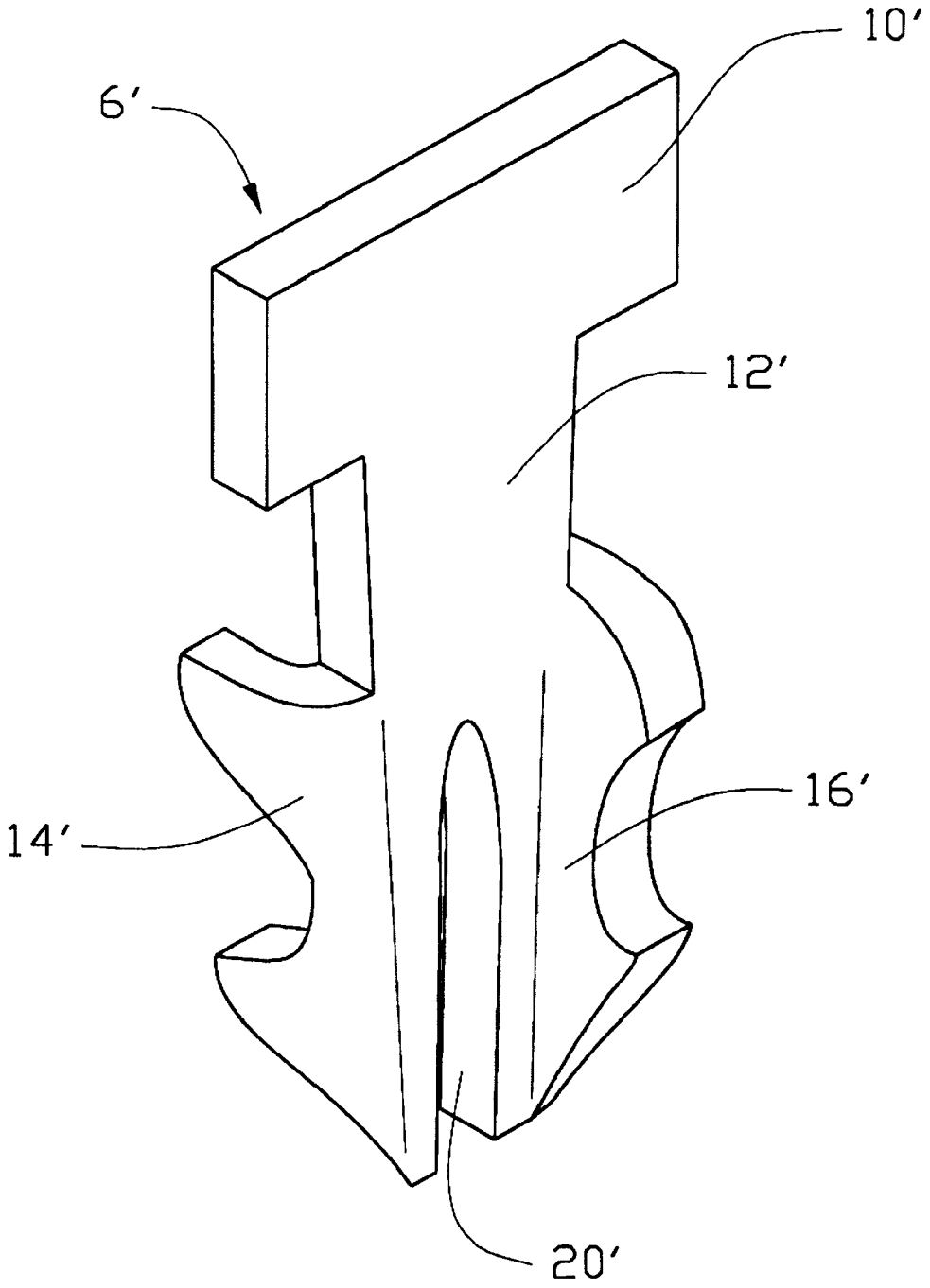
FIG. 5 is a perspective view of a boardlock in accordance with a second embodiment of the present invention.

Referring to FIG. 5, a boardlock 6' of a second embodiment of the present invention includes a base 10' and a latch 12' extending from the base 10'. The latch 12' forms first and second barbs 14', 16' extending from opposite edges thereof. An elongate cutout 20' is formed between the first and the second barbs 14', 16'. The boardlock 6' serves the same functions as the boardlock 6 of the first embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A boardlock for an electrical connector, comprising:

a base adapted for being attached to a housing of the electrical connector; and a latch extending from the base and comprising a planar portion and first and second barbs on two opposite side edges of the planar portion, the first and second barbs being respectively bent to lie in opposite sides of the planar portion;

wherein the first and second barbs each include two protrusions;

wherein the first and second barbs are proximate a free end of the latch;

wherein the first and second barbs are respectively bent along respective lines which convergingly extend toward a free end of the latch;

wherein an elongate aperture is formed in the latch between the first and second barbs.

2. A boardlock for an electrical connector, comprising:

a base adapted for being attached to a housing of the electrical connector; and a latch extending from the base and comprising a planar portion and first and second barbs on two opposite side edges of the planar portion, the first and second barbs being respectively bent to lie on opposite sides of the planar portion;

wherein the first and second barbs each include two protrusions;

wherein the first and second barbs are proximate a free end of the latch;

wherein the first and second barbs are respectively bent along respective lines which convergingly extend toward a free end of the latch;

wherein an elongate cutout is formed in the latch between the first and second barbs.

* * * * *